US005511481A

United States Patent [19]

Stephens

[11] Patent Number: 5,511,481

[45] Date of Patent: Apr. 30, 1996

[54] LIGHTWEIGHT PYROTECHNIC COMPRESSOR

[75] Inventor: William D. Stephens, Huntsville, Ala.

[73] Assignee: The United States of America as represented by the Secretary of the Army, Washington, D.C.

[21] Appl. No.: 380,171

[22] Filed: Jan. 23, 1995

[51] Int. Cl.[6] ..... F42B 3/00; F42B 5/02; C06D 5/00

[52] U.S. Cl. ..... 102/326; 102/330; 102/440; 102/531

[58] Field of Search ..... 102/325–330, 102/332, 340, 440, 530, 531

[56] References Cited

U.S. PATENT DOCUMENTS

| | | | |
|---|---|---|---|
| 2,645,181 | 7/1953 | Bugg | 102/25 |
| 3,431,853 | 3/1969 | Warner et al. | 102/39 |
| 3,527,137 | 9/1970 | Scanlon | 89/1 |
| 3,758,131 | 9/1973 | Stephenson et al. | 280/150 AB |
| 3,895,579 | 7/1975 | Gawlick et al. | 102/65.2 |
| 4,044,684 | 8/1977 | Gaggini et al. | 102/90 |
| 4,920,885 | 5/1990 | Bowman et al. | 102/281 |
| 5,438,907 | 8/1995 | Reynolds et al. | 89/14.5 |

*Primary Examiner*—Peter A. Nelson
*Attorney, Agent, or Firm*—Anthony Lane; Hay Kyung Chang

[57] ABSTRACT

A breech assembly similar to a modified shotgun breech is used to fire gaseous combustion products from a shotgun type pyrotechnic cartridge into a tank that holds the compressed gas. This compressed gas can then be used to drive power tools, inflation assemblies or any device which normally operates on compressed air.

1 Claim, 1 Drawing Sheet

LIGHTWEIGHT PYROTECHNIC COMPRESSOR

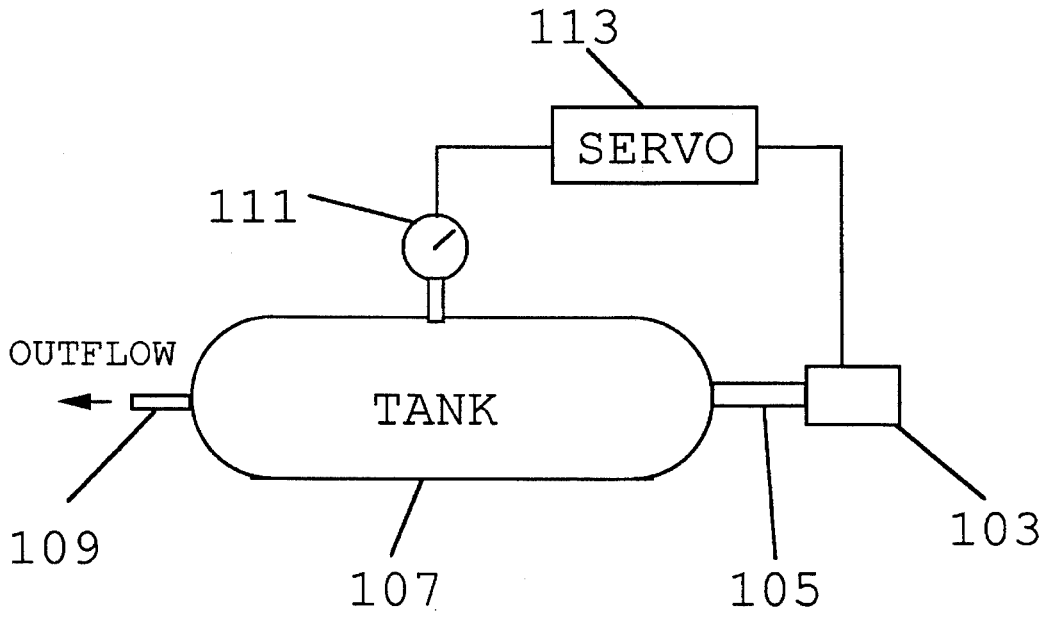
LIGHTWEIGHT PYROTECHNIC COMPRESSOR

LIGHTWEIGHT PYROTECHNIC COMPRESSOR

The invention described herein may be manufactured, used and licensed by or for the Government for governmental purposes without the payment to me of any royalties thereon.

BACKGROUND OF THE INVENTION

Power tools such as nail drivers or wrenches are often driven by compressed air. One advantage of using compressed air is that the device producing it is portable to remote locations where there is no electricity. However, under the current state of the art, the device is extremely heavy because the two major components of the device, i.e. the compressor and the gasoline internal combustion engine that is used to drive the compressor, are usually made of heavy steel. The choice of material is dictated by the requirement that the device must withstand the pressure of an internal combustion engine and the pressure generated in the compressor. Nonetheless it renders the device difficult to transport and handle to remote work sites.

SUMMARY OF THE INVENTION

The Lightweight Pyrotechnic Compressor eliminates the two major heavy components of the state of the art air compressor and utilizes the fact that gases other than air, such as nitrogen, can be used as well to produce pneumatic power. Both the gasoline internal combustion engine and the compressor are eliminated and replaced by a lightweight firing chamber. The firing chamber is made of a modified shotgun breech into which a cartridge containing clean-burning, gas-generating material is inserted. When triggered, combustion occurs inside the chamber and the gas generated thereby flows into a tank through a check valve that connects the chamber with the tank. The pyrotechnic compressor thus assembled is lightweight due to the lightness of the firing chamber and produces sufficient pneumatic power to drive ordinary power tools used for small jobs in remote locations.

DESCRIPTIONS OF THE DRAWING

The single FIGURE shows the preferred embodiment of the invention.

DESCRIPTION OF THE PREFERRED EMBODIMENT

With reference now to the drawing wherein like numbers refer to like parts, the structure and operation of the Lightweight Pyrotechnic Compressor is explained.

Firing chamber 103 comprises a modified shotgun breech that is capable of accepting therein a cartridge similar to a shotgun shell from which pellets or projectiles have been removed. Instead, the cartridge contains a clean-burning, gas-generating composition similar to the type found in automobile crash bag safety devices. There are a number of such pyrotechnic compositions available that will produce high pressure gas. They are normally comprised of clean-burning fuel and oxidizer elements such as nitrates, nitro compounds, nitramines, azides or other clean burning oxidizing materials, as well as combustion additives and a primer. Then after the insertion of a cartridge, chamber 103 may be manually triggered to initiate the combustion. The gas generated flows via check valve 105 into tank 107 where it is held until regulator 109 releases the gas, permitting the outflow thereof at a predetermined pressure level as useful power. Pressure gauge 111 provides a constant reading of the gas pressure inside the tank.

The simple configuration described above c be automated by inserting several cartridges into the chamber at once and by coupling servo mechanism 113 between gauge 111 and chamber 103 so that whenever the pressure reading falls below a predetermined level, servo 113 triggers chamber 103 thereby causing production of more pressurized gas until the gauge reads at the desired level.

With the lightweight pyrotechnic compressor as described above and a box of gas-generator cartridges, the entire unit is lightweight, easy to transport and requires no external power sources.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

I claim:

1. A lightweight pyrotechnic compressor comprising a shotgun breech, said breech being suitable for receiving therein at least one cartridge containing pyrotechnic composition and generating gas therefrom, a tank for storing gas, said tank being equipped with a gauge for monitoring the gas pressure inside said tank and producing pressure signals in response thereto, a check valve coupled between said shotgun breech and said tank to allow the flow of gas from said shotgun breech to said tank, a servo, said servo being coupled between said gauge and said shotgun breech such that said servo receives the pressure signals from said gauge and at a predetermined pressure activates said shotgun breech to combust at least one cartridge; and a means for releasing gas, said releasing means being connected to said tank to permit issuance of gas therefrom at a predetermined pressure level as useful power.

* * * * *